United States Patent [19]

Ahearn et al.

[11] 4,147,958

[45] Apr. 3, 1979

[54] MULTICOLOR GAS DISCHARGE DISPLAY MEMORY PANEL

[75] Inventors: William E. Ahearn, Purdys; Kyu C. Park, Yorktown Heights, both of N.Y.

[73] Assignee: International Business Machines Corporation, Armonk, N.Y.

[21] Appl. No.: 811,749

[22] Filed: Jun. 30, 1977

[51] Int. Cl.[2] ..... H05B 37/00; H05B 39/00; H05B 41/00

[52] U.S. Cl. ..... 315/169.4; 313/223; 340/704; 340/772; 340/779; 340/805

[58] Field of Search ..... 315/169 R, 169 TV; 313/223; 340/324 M

[56] References Cited

U.S. PATENT DOCUMENTS

| | | | |
|---|---|---|---|
| 3,704,386 | 11/1972 | Cola | 315/169 TV X |
| 3,761,773 | 9/1973 | Johnson et al. | 315/169 TV |
| 3,925,697 | 12/1975 | Fein et al. | 313/223 |
| 4,053,804 | 10/1977 | Aboelfotoh | 315/169 TV X |

*Primary Examiner*—Alfred E. Smith
*Assistant Examiner*—Robert E. Wise
*Attorney, Agent, or Firm*—Bernard N. Wiener

[57] ABSTRACT

A method is disclosed for improving gas display panel performance with improved resolution, color, memory margin and brightness as a result of helium based mixtures in a panel structure using evaporated glass technology, e.g., borosilicate glass technology. Multicolor emissions can be achieved directly from the helium based mixtures, and additional color enhancement and selection can be accomplished by varying the gas parameters of pressure and dopant concentration and the sustain voltage waveform drive conditions. Color selection from the helium based mixtures with molecular dopants can be made using an optical filter or a colored glass substrate.

Through the practice of this disclosure, a gas panel is obtained that emits white light using a helium based mixture doped with oxygen. It is a Penning mixture with optical radiation in the visible part of the spectrum due to systems of emission bands from the ionized oxygen molecules. The first negative system exhibits four strong bands that vary from 75 to 125A in width and account for green, yellow and red colors. In addition, four weaker bands are observed for the second negative system which account for the blue color.

26 Claims, 7 Drawing Figures

FIG. 1A
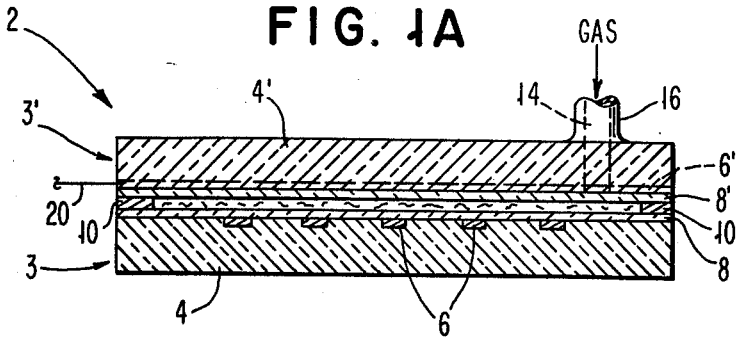
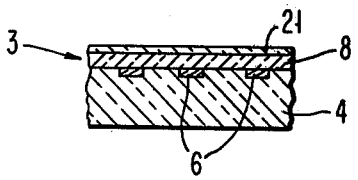
FIG. 1B
FIG. 1C
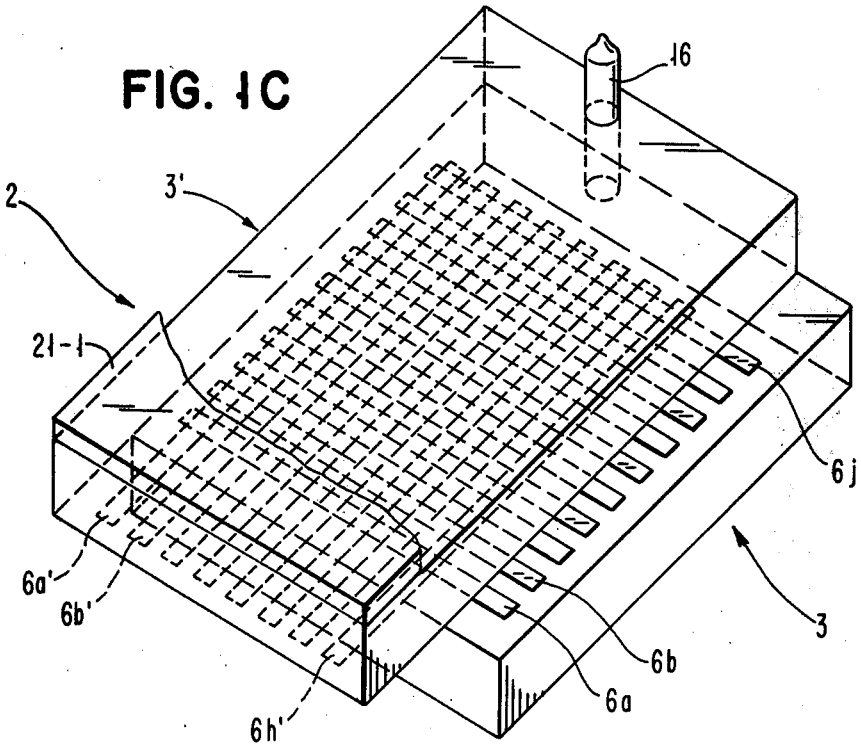

MULTICOLOR GAS DISCHARGE DISPLAY MEMORY PANEL

BACKGROUND OF THE INVENTION

The present invention relates to AC gas discharge display and memory panels. More particularly, the present invention relates to a multicolor AC gas discharge display and memory panel exhibiting high luminous efficiency.

One of the limitations of the conventional AC gas discharge display panel utilizing the luminous gas mixture is that it produces only one given color; e.g., reddish-orange color from neon plus argon mixture and blue color from argon plus mercury mixture. The prior art has not obtained flexibility of color presentation with high luminous intensity.

Alternative color capability in gas discharge display panels has been pursued in the prior art by an indirect method. Basically, this indirect method utilizes photosensitive phosphors in the active discharge region, which phosphors are stimulated by ultraviolet emission from a suitable gas mixture. Various arrangements have been implemented in the prior art utilizing this principle. However, since the principle utilizes bulk phosphors stimulated by emission from the gas, additional and somewhat complex panel fabrication is required, and brightness and efficiencies are lost.

OBJECTS OF THE INVENTION

It is an object of this invention to provide a multicolor AC gas discharge memory panel with high margin and high resolution from a Penning mixture of He and another species.

It is another object of this invention to provide a gas discharge memory panel which provides apparently white light display.

It is another object of this invention to provide a gas discharge memory panel wherein He plus Xe or He plus Kr produces strong ultraviolet emission suitable for excitation of thin film phosphors and electroluminescent materials.

It is another object of this invention to provide a gas dicharge memory panel wherein luminous brightness is correlated directly as a function of thickness of the dielectric layer established over the conductors on a glass substrate.

It is another object of this invention to provide a gas discharge memory panel wherein a Penning mixture of He plus $O_2$ produces the desired stoichiometry of the MgO layer necessary for a uniform coefficient of secondary electron coefficient over the entire surface.

It is another object of this invention to provide a multicolor AC gas discharge display panel which exhibits high luminous efficiency.

SUMMARY OF THE INVENTION

A method is disclosed for improving gas display panel performance with improved resolution, color, memory margin and brightness as a result of helium based mixtures in a panel structure using evaporated glass technology, e.g., borosilicate glass technology. Multicolor emissions can be achieved directly from the helium based mixtures, and additional color enhancement and selection can be accomplished by varying the gas parameters of pressure and dopant concentration and the sustain voltage waveform drive conditions. Color selection from the helium based mixtures with molecular dopants can be made using an optical filter or a colored glass substrate.

Through the practice of this invention, a gas panel that emits white light is obtained using a helium based mixture doped with oxygen. Data shows this to be a Penning mixture with optical radiation in the visible part of the spectrum due to systems of emission bands attributed to the ionized oxygen molecule. The first negative system exhibits four strong bands that vary from 75 to 125Å in width and account for green, yellow and red colors. In addition, four weaker bands are observed for the second negative system which account for blue color.

Structures, methods of fabricating them, useful gas mixtures and general modes of operation are obtained through the practice of this invention which obtain readily a variety of single color displays as well as multicolor displays.

The oxygen molecular ion (1st and 2nd positive series) has strong emission bands in the red, green, blue and yellow regions. The He metastable atoms provide sufficient energy via a Penning process for these preferred transitions. Other molecules admixed with He in the gas phase yield comparable results.

The several primary colors contained within the white color may be resolved and recombined to provide multicolor or monochromatic behavior in a single panel structure or which may be resolved partially and combined thereafter with the color of other discharge gas mixtures.

FEATURES OF THE INVENTION

A feature of this invention is a multiple color gas display panel with enhanced line resolution and memory margin at high frequency drive levels, e.g., <1 MHz.

Another feature of this invention is a method for improving gas display panel performance with improved resolution, color, margin and brightness as a result of helium based mixtures in a panel structure using evaporated glass technology. Color selection from the helium based mixtures with molecular dopants can be enhanced using optical filters.

Another feature of this invention is the use of other than He plus $O_2$ mixtures with alternative dopants for short wavelength (ultraviolet) emissions. These properties can be used for thin film phosphors and electroluminescent materials with minimal sputtering. Illustratively, a mixture of He plus 0.2%$H_2$ produces a yellow color of 7 ft-lamberts at 240 KHz with a 25 volts margin for sustain voltages of 112/87 $V_s^{max}/V_s^{min}$ for a panel structure similar to that used with He plus 0.2% $O_2$ mixtures.

TABULAR DATA FOR THE INVENTION

Table I shows the wavelengths and bandwidths from oxygen whose superposition gives an exemplary white panel output.

TABLE I

| Color | Bandwidth (Å) | Central Wavelength (Å) |
|---|---|---|
| Green | 75 | 5250 |
| | 85 | 5595 |
| Yellow | 75* | 5250* |
| | 75 | 5985 |
| Red | 125 | 6375 |
| Blue | 150* | 4100* |
| | 150* | 4400* |

TABLE I-continued

| Color | Bandwidth (Å) | Central Wavelength (Å) |
|---|---|---|
| | 150* | 4700* |

*2nd negative system.

In Table I the asterisks denote those bands associated with the oxygen second negative system. Little contribution to the color is made by atomic oxygen and helium spectral lines. The helium emission degrades the color if the pressure is too low (<100 Torr) or if the oxygen concentration is too insufficient (less than 0.1%).

Table II shows typical operating characteristics for an AC plasma panel filled to 400 Torr with a He plus 0.2% $O_2$ mixture.

TABLE II

| | |
|---|---|
| Color: | White |
| Brighteness: | 20 ft-lamberts at 240 KHz |
| | 4.16 ft-lamberts green at 240 KHz |
| Sustain Voltages: | 110/85 $V_s^{max}/V_s^{min}$ |
| margin: | 25 volts |
| Current: | 300 μamps/cell at 240 KHz |
| Borosilicate: | 3.2 μm |
| MgO: | 0.2 μm |
| Line Density: | 50 lines/inch with 4 mil max. width |
| Chamber Gap: | 4 mils |
| Turn-on Time: | >500 nanoseconds at 240 KHz |

PHYSICS OF THE INVENTION

The discharge condition favors the excitation of He metastable states as direct electron excitation or charge transfer to $O_2$ atoms is negligible. Basically, the light emission from the gas dishcarge panel of this invention involves a three-step operation. In the first step there is populating of the main source, He, to metastable states. During the second step there is transfer of collisional energy (Penning ionization) from the He metastable states to the $O_2$ molecules to form $O_2$ ions and excited $O_2$ molecules. Finally, in the third step, the $O_2$ ions recombine with electrons to form $O_2$ atoms and emit white light, which is a combination of the various visible spectral lines.

AC operation involves a memory or storage effect achieved by charging up the capacitance across a given cell. The capacitance is a result of, the dielectric overcoat on the conductive lines. Alternate sides of the cell charge up with alternate polarity on alternate half cycles of the AC signal. Within a given half cycle, when the cell has reached a fully charged condition, the voltage across the intervening gas of the cell drops to approximately zero. This alternate charging over half cycles of the applied alternating voltages occurs relatively rapidly. That interval provides sufficient time for the electrons to thermalize, i.e., achieve a Gaussian energy distribution and to permit an efficient recombination with the $O_2$ ions.

The particular gas mixture employed in accordance with the present invention exhibits the bistable characteristics required for AC operation. Pure helium does not show a bistable hysteresis characteristic. In addition, efficient operation is also based upon the favorable energy match between the He metastables (5eV) and the ionization level (4eV) of the $O_2$ molecular.

BRIEF DESCRIPTION OF THE DRAWINGS

FIG. 1A is a schematic diagram of the gas panel whose dielectric layers are fabricated in accordance with the principles of the present invention.

FIG. 1B is a modification of the structure of FIG. 1 showing the electron emissive MgO layer.

FIG. 1C represents a typical AC gas discharge display panel configuration shown in perspective.

FIGS. 3–5 present data in graph format on operation of a gas discharge panel using a helium plus oxygen gas mixture in accordance with the principles of this invention wherein:

FIG. 3 shows the relationship between luminous brightness of the panel and thickness of the dielectric layer on the conductors;

FIG. 4 shows the linear dependence of panel brightness reverses frequency of the drive voltage; and FIG. 5 shows the relationships between gas pressure and brightness and gas pressure and the sustain drive voltages.

PRACTICE OF THE INVENTION

Figure 2:
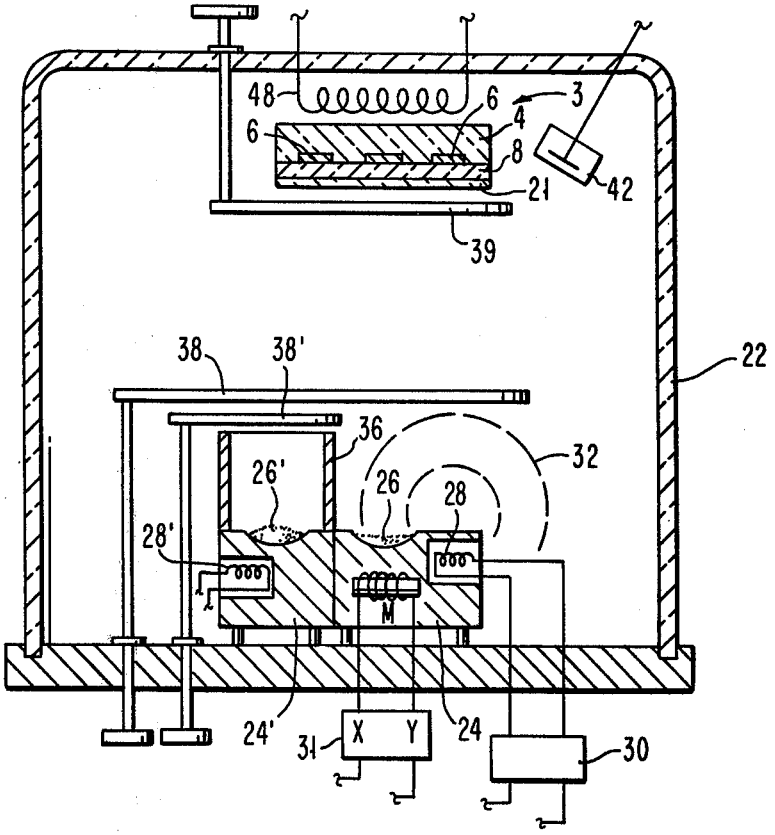
FIG. 2 is a schematic drawing showing an evacuated chamber employing an evaporation system for depositing glass dielectric layers over the substrates for controlling brightness of the luminous gas mixture in accordance with the principles of this invention.

For optimum color, brightness, glow confinement, and operating current-voltage characteristics, the gas mixture should fall within the following limits: pressure, 300–500 Torr; and oxygen concentration, 0.1–5%. The pressure limit relates to suppressing the helium emission which out of this range has the tendency to form a pinkish halo around the active discharge sites. The oxygen concentration is dependent on the panel surface area. As the equilibrium is established between the gas and surface, some of the oxygen is absorbed on the MgO surface. The amount of oxygen lost to the surface is dependent on the surface area of the MgO topcoat. As an example, for a larger panel this absorption of oxygen must be compensated for by filling the panel with more highly doped oxygen mixture. A result of the oxygen being absorbed on the surface is to enhance its stoichiometry which results in a more uniform MgO surface. This is evident by the width of the voltage spread while igniting all cells on or off.

One significant result obtained from the oxygen interaction with the MgO and the relationship of panel brightness to borosilicate glass thickness variation is an appreciable increase in the panel margin which is the difference between the maximum voltage required to initiate gas discharge of a cell and the minimum voltage which will sustain it thereafter. For example, a panel margin as high as 26 volts with $105/79V_s^{max}/V_s^{min}$ sustain voltages has been measured on several 240 character panels with 3 μm (micron $\equiv 10^{-6}$ meter) thickness of borosilicate glass dielectric. After the initial burn-in, the panels are stable with the I-V characteristics being quite reproducible.

Another result achieved with the He plus dopant, e.g., $O_2$ mixture, in accordance with the principles of this invention, is an improved glow confinement at the active gas discharge sites. This results in a sharp, crisp display panel. Panels made of electrode line densities as high as 125 lines/inch with 1, 2 and 4 mil line widths show no appreciable loss in margin. These same panels are less sensitive to chamber gap variations. For conventional panels that contain neon based mixtures a loss in margin occurs as 50 lines/inch is exceeded.

Within the limits of gas pressures and oxygen concentrations specified hereinbefore for the practice of this invention, it is necessary to vary the panel drive frequency and the dielectric thickness for optimum brightness conditions. To enhance the panel brightness, higher frequency sustain waveforms can be used. For example, a 3 μm borosilicate glass panel, operated at 240 KHz produces 20 ft-lamberts of white light or 4 ft-lamberts of green light. No degradation of panel margin is evident at this higher frequency. Panel margins have been measured at as high as 3 megahertz with no appreciable margin degradation. Conventional neon-argon mixtures show a collapse of margin starting at approximately 100 kilohertz.

FABRICATION OF GAS DISCHARGE DISPLAY PANEL

Fabrication technology suitable for an exemplary structure for practice of this invention is disclosed in copending and commonly assigned application Ser. No. 703,382 filed July 7, 1976 and issued Aug. 1, 1978 as U.S. Pat. No. 4,104,418 (which is a continuation of application Ser. No. 462,289 filed Apr. 19, 1974) and will now be outlined herein.

For exemplary practice of this invention, FIG. 1A illustrates a typical gas panel display unit 2 which comprises a single panel or plate 3 consisting of a glass substrate 4 having parallel lines of metal 6 either on or imbedded in substrate 4. A dielectric material 8 is deposited by an electron-gun deposition technique to be described hereinafter with particular reference to FIG. 2. Borosilicate glass is an acceptable and preferred material 8. The dielectric material 8 must be electron emissive, which can be accomplished either by incorporating electron emissive material within the borosilicate glass 8 or by depositing an electron emissive layer 21 over layer 8 as shown in FIG. 1B. A suitable electron emissive layer is MgO.

A second panel 3' which is identical to the first panel comprises a glass substrate 4', into which are imbedded parallel metal lines 6' with an electron-gun deposited layer 8' of borosilicate glass. The parallel metal lines 6 of one panel are established orthogonal to all the metal lines 6' of the other panel. The two panels are secured in position with a rectangular frame 10 placed between the panels of a solid tubular-shaped sealing glass rod. Pressure may be used to enhance the fusing of the two panels together when the sealing glass rod 10 is heated. During the fusing step, a shim (not shown) is placed between the glass panels to set minimum separation of the panels as heat is uniformly applied to both panels to achieve a requisite separation between panels.

A hole 14 is drilled through one of the two glass panels 3' and a tube 16 is glass soldered to that opening so that after the 2–4 mil spacing between panels 3 and 3' has been evacuated, suitable gas mixture in accordance with the principles of this invention is inserted through the tube at a pressure in the approximate range of 300–500 torr. After the ionizable gas has been inserted into the panel space, the hole 14 is sealed off by tipping off the tube 16. Current-carrying leads 20 are connected to each metal line 6 and 6', so that appropriate actuating signals can be sent through them for exciting or de-exciting the gas discharge panel.

FIG. 1C is a perspective view of an AC gas discharge display panel arrangement for the practice of this invention as presented in cross-sectional views in FIGS. 1A and 1B. The panel comprises an upper glass plate 3 and a lower glass plate 3' separated from and sealed to provide an intervening chamber which is filled with a gas mixture in accordance with the principles of the present invention.

Electrically conductive parallel lines 6*a*–6*h* are disposed on the lower side of the upper plate 4, and serve as electrodes for supplying a given electrical signal to the intervening sealed chamber between the plates. Electrically conductive parallel lines 6'*a*–6'*j* are disposed on the upper side of the lower glass plate 4' and serve as electrodes for supplying a given electrical signal to the other side of the intervening sealed chamber between the plates. Typically, the sets of parallel lines are orthogonal to one another and comprise A1-Cu-Al or Al-Cu alloy conductors. The lines on each plate are coated with a dielectric glass which is coated with a refractory layer, such as MgO.

In order to evacuate the intervening sealed chamber between plates 3 and 3' and fill it with the luminous gas provided in accordance with the principles of this invention, a tubulation assembly 19 is provided, which is the tube 16 of FIG. 1A shown as sealed off.

The depositing of the borosilicate glass layers 8 and 8' and the MgO layer 21 will now be described with reference to the system shown schematically in FIG. 2. It consists of an evacuated chamber 22 in which substrate 4 is established and glass layer 8 and MgO layer 21 are deposited in two sequential evaporations from a single pumpdown. Chamber 22 is evaporated by conventional vacuum pump technology, now shown, via tube 16. Bulk borosilicate glass source 26 is placed in a copper boat 24 within the chamber 22. A tungsten filament 28 within the boat housing is connected to a source 30 of electrical energy for heating said filament 28. Electrons 32 emitted from filament 28 are attracted by a magnet M, shown in dotted line within the boat 24, but not shown in boat 24' for clarity, onto the source material 26 for heating it.

An X-Y sweep control unit 31 provides for longitudinal beam positioning and for automatic control of sweeping of the electron beam of both longitudinally and laterally. A large surface area of the source material 26 is uniformly heated and melted. Shutters 38 and 38' interposable between the source materials 26 and 26' respectively and substrate 4 with metallurgy 6. Shield 36, separates boats 24 and 24' and also helps to prevent cross contamination. Chunks of MgO single crystal source 26' are placed into the boat 24', and deposition of the MgO layer 21 over the glass layer 8 is carried out by opening shutters 38' and 39 during the evaporation of desired amount of MgO. Shutter 38' is in another plane than that of shutter 38 so that the MgO source 26' is bombarded with electrons from electron filament source 28'. Electrical power connections for heating the filament 28' and for deflecting emitted electrons onto MgO source 26' are not shown. Substrate 4 is held at approximately 10 inches away from the evaporation source. A heater 48 maintains it at desired elevated temperatures during the depositions of glass layer 8 and of electron emissive layer 21. The thicknesses of the deposited layers 8 and 21 are monitored by a detector 42 during the separate depositions.

As an illustrative example, a borosilicate glass source 26 is heated by electron beam bombardment in the evacuated chamber which is maintained at $10^{-6}$ torr so that a molten pool of borosilicate is created having an area of in the approximate range of 2 to 10 $cm^2$. The power supplied to evaporate the borosilicate glass source material is increased gradually, so that the pre-set area is heated uniformly to a level slightly higher than the eventual power level needed for a desired steady evaporation rate. During the initial heating period, it is not desirable to exceed the power level needed for the final steady evaporation rate although an excess of 20% or less of that power level is tolerable. A large uniformly heated molten pool avoids undesirable fractionation of the borosilicate glass. Control of both longitudinal and lateral electron beam sweep and a simultaneous control of heating rate accomplishes uniform heating over a large area. Shutter 38 is interposed between source 26 and substrate 4 until the source 26 is evaporating at a steady rate. Illustratively, the substrate 4 is maintained at 200° C. during evaporation of the borosilicate glass. Then, the shutter 38 is taken out of the path of the evaporating source 26. Accordingly, 3 to 3.5 micron thick layer 8 of transparent and smooth borosilicate glass can be deposited in less than 10 minutes.

CONSIDERATIONS FOR THE INVENTION

Several considerations for beneficial practice of this invention will now be presented.

Color selection or enhancement can be achieved for the practice of this invention in several exemplary ways: (1) one or more optical band pass filters are associated integrally with or separately from a luminous substrate; (2) applied voltage waveform selection; varying gas composition and pressure. Ancillary technology for selecting and enhancing a particular color will be illustrated with reference to FIG. 1C wherein an optical filter layer 21-1 is shown on the plate 3'. In this instance, the filter 21-1 is a thin film selected to pass frequencies for a particular color, e.g., blue, from a gas mixture of He plus $O_2$.

Instead of optical filters, phosphors or electroluminescent materials can be placed at selected display cell locations (defined by pairs of electrodes) to be excited by light emission from the gas mixture. The memory, i.e., the image persistence, of electroluminescence material can thus be beneficially utilized.

Figure 3:
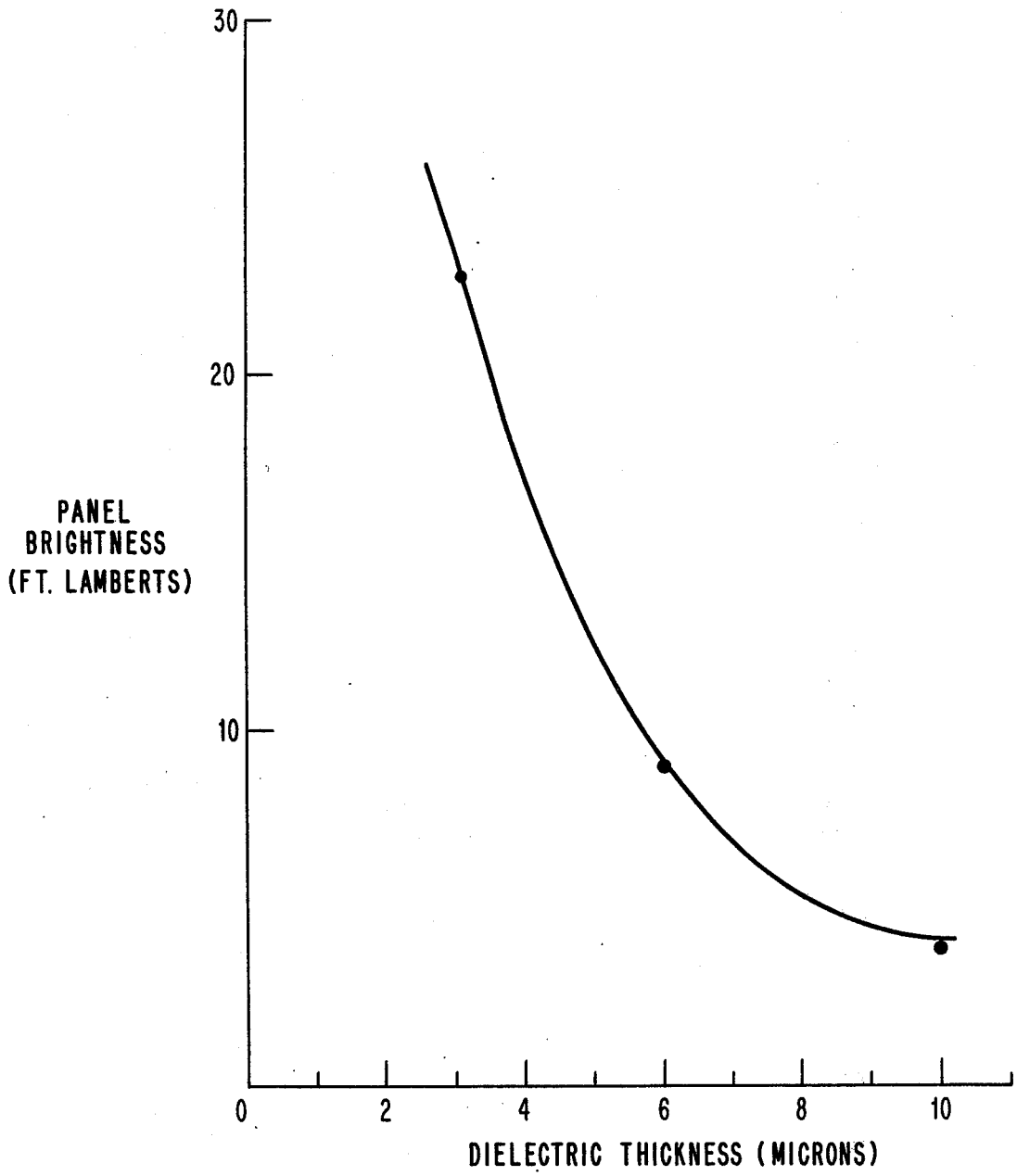

The evaporated glass technology allows considerable precision in controlling the dielectric film thickness. It has been discovered for the practice of this invention that the thickness of the dielectric layer when applied to an AC plasma display panel determines to a large measure the capacitive reactance of the discharge cell. This in turn determines the amount of avalanche current that flows through the cell which is directly proportional to the optical emission level or brightness. FIG. 3 shows data on how the brightness is controlled over the 3–10 micron dielectric layer thickness range, e.g., layers 8 and 8' of FIGS. 1A and 1B. Precision of the dielectric thickness must be carefully controlled below about 3 microns because dielectric breakdown of the film must be avoided. The operational parameters of the gas discharge panel used for obtaining the data of FIG. 3 are: 0.2% $O_2$/He gas mixture; gas pressure of 500 Torr.; and drive frequency of 240 kilohertz.

Figure 4:
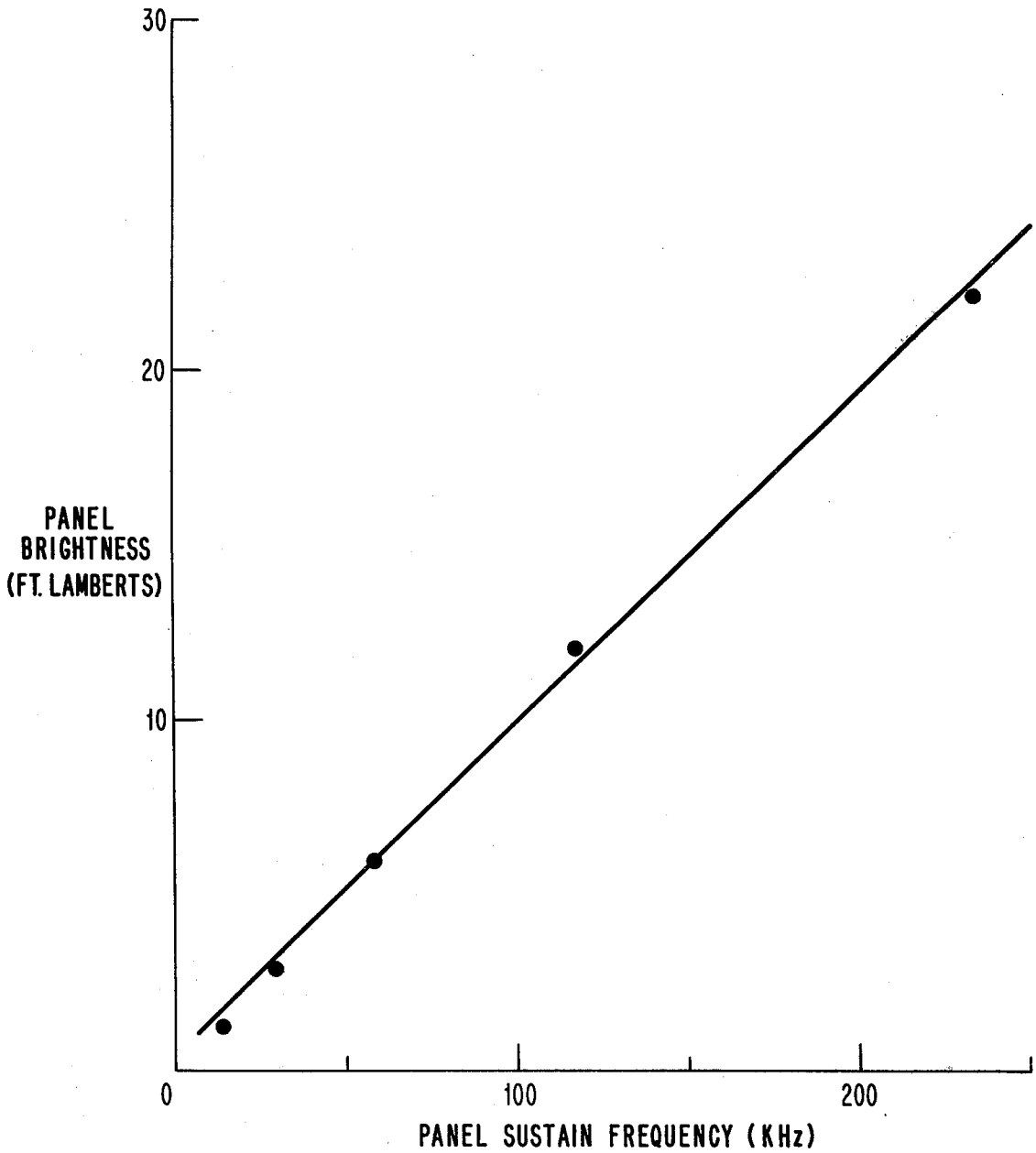

An apparently unique property of a helium based gas mixture provided for the practice of this invention is its capability to operate at high frequencies e.g., at 3 megahertz and above, without a significant loss of panel margin or increase in sustain voltage levels. This property allows the frequency to be adjusted to achieve a brightness level suitable for the desired display application. FIG. 4 shows data for the linear dependence of brightness on frequency for a 0.2% $O_2$/He mixture at 500 Torr operating in a typical AC plasma panel structure.

Figure 5:
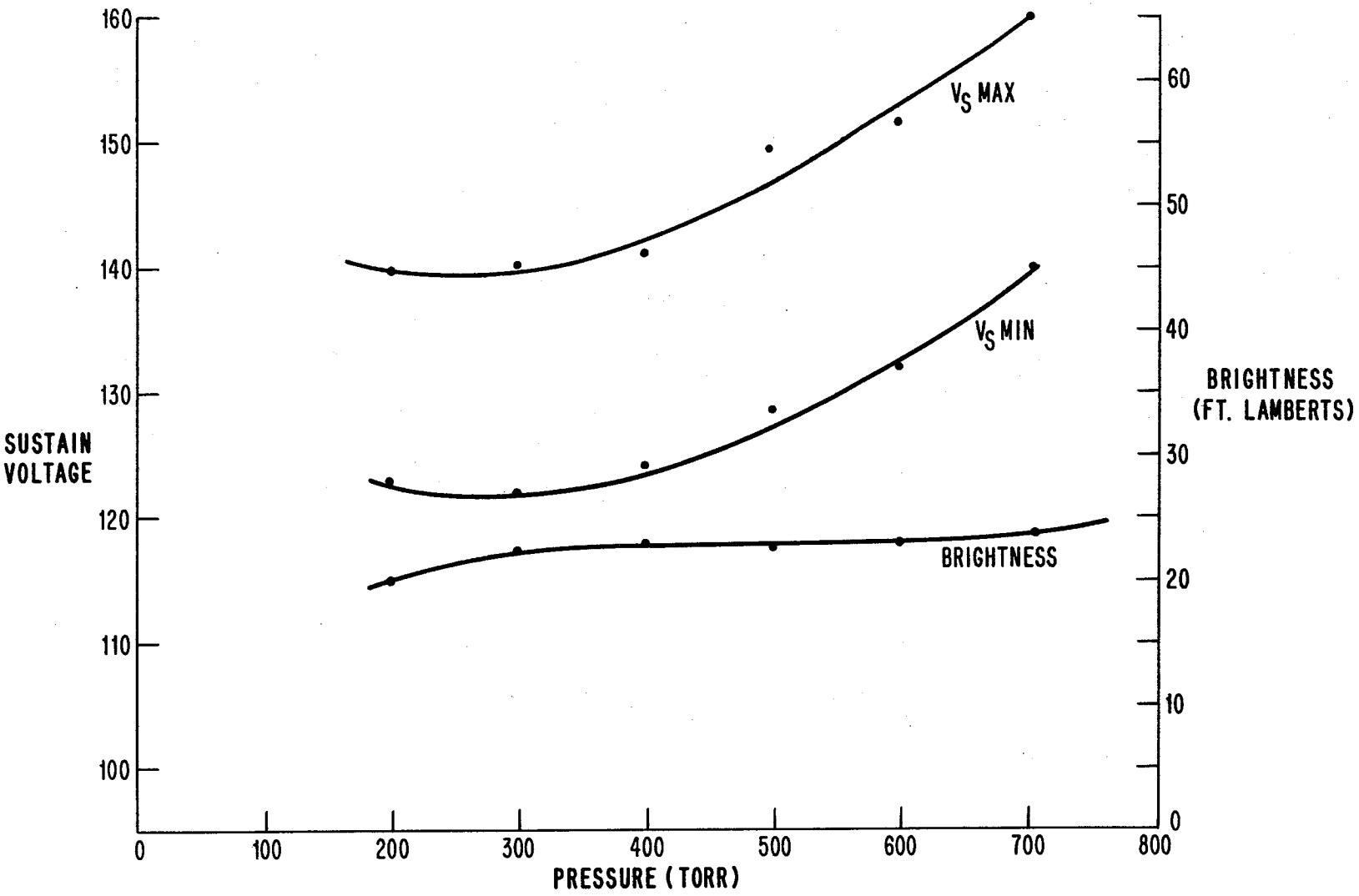

FIG. 5 shows the sustain voltage and brightness relationships for a 0.2% $O_2$/He mixture at 500 Torr under a 240 KHz drive condition as functions of gas pressure. A typical panel structure was employed that had 3 micron thick dielectric layers, 8 and 8', MgO topcoat 21 and a 4 mil chamber spacing between plates 3 and 3'. It is observed that the brightness is relatively constant over the pressure range shown. Actually, this holds up to at least 1000 Torr, the limit of measurement capability available herefor. As shown in FIG. 5, the voltage difference between the two sustain levels is 20 volts or greater, which number can be referred to as the panel memory margin. It is noted that an optimum margin voltage level occurs in the 400–500 Torr range.

It has been determined for the practice of this invention that an appropriate range of thickness for the secondary electron emission layer, e.g., MgO layer 21 of FIG. 1A, is approximately in the range of 0.2 to 1.0 microns; and for the glass dielectric layer 8 and 8' of FIGS. 1A and 1B is approximately in the range of 3 to 10 microns.

He based mixtures in accordance with the principles of this invention for color capability in gas discharge panel technology allow high line density i.e. great resolution, and high margin panels. Further, such helium based gas mixtures provide suitable condition for thin film phosphor excitation. This results also in high brightness for high line density using narrow lines, e.g., 1 mil or less, for both multicolor and white light capability.

Gas panels that emit blue light have been also obtained for the practice of this. The blue emission results from the discharge of gas mixtures of He doped with either krypton or xenon. The operating characteristics showed greatly enhanced static margin.

A gas mixture containing 0.25% krypton in helium was metered into a demountable chamber which contained a set of 2 inch × 2 inch plates. These plates had a 7 micron borosilicate layer with a 2000Å MgO overcoat. The chamber was filled to 400 Torr with the 0.25% Kr/He mixture and panel operation was obtained with the plates set to a 4 mil chamber spacing. The primary spectral emission lines were from excited krypton states with strong (blue) emission being recorded at 4274Å, 4320Å, 4363Å, 4454Å, 4464Å and 4502Å. The radiation from the individual cells was crisp and well defined. The panel brightness with the 0.25% Kr/He gas mixture was 2 ft.-lamberts at a 30 KHz driver frequency. The operating voltage range was $133/102 V_s^{max}/V_s^{min}$ for a static measurement which yields a 31 volt margin. Time resolution of the helium and krypton spectral lines showed the helium emission to be slightly less than 1 μsec. in duration with the krypton being 75 microseconds which is an indication of a Penning interaction between the helium metastable atoms and the krypton atoms.

The following Table III presents exemplary operational data for comparison of several different gas mixtures in accordance with the principles of this invention. The test AC gas panel was pressured to 500 Torr; the borosilicate glass layer thickness was 3.2 microns; and the drive frequency was 240 kilohertz.

TABLE III

| | HE/XE (0.2%) | HE/$N_2$ (0.2%) | HE/$O_2$ (0.2%) | STANDARD PANEL HE/NE (0.1%) |
|---|---|---|---|---|
| $V_S^{MAX}/V_S^{MIN}$ | 112/90 | 138/110 | 152/130 | 99/84 |
| $I_{PK}$ (μA/CELL) | 190 | 300 | 300 | ≈100 |
| B Ft.-Lamberts | 6-7.5 | 15-20 | 18-23 | 10 |
| COLOR | BLUE | VIOLET | WHITE | ORANGE |

The beneficial aspects of gas discharge panel operation utilizing helium based gas mixture has been presented hereinbefore. The species for doping helium to obtain Penning interactions has been exemplary. By reference to the literature of atomic and molecular spectra, other suitable dopants for helium will be understood for practice of this invention. Exemplary literature citations for this purpose whose disclosure is incorporated herein by reference are the books: (1) "The Identification of Molecular Spectra", by R. W. B. Pearse and A. G. Gaydon, 3rd Edition, Chapman and Hall Ltd., London, 1965; (2) "Tables of Spectral Lines of Neutral and Ionized Atoms", A. R. Striganov and N. S. Sventitskii, I. F. I./Plenum, New York-Washington, 1968.

Color selection and enhancement can be achieved for the practice of this invention by adjusting the shape and width of the voltage waveform to match the helium based mixture employed. This takes into account the very fast switching times associated with the various helium based mixtures with narrow dopants.

What is claimed is:

1. In an AC gas discharge display panel having
an open panel structure with at least two substrates and respective dielectric layers thereon,
a luminous ionizable gaseous medium with a pronounced visible discharge emission between said dielectric layers and
exhibiting characteristics such that said gaseous medium may periodically be driven by the drive voltage therefor to discharge condition thereacross, the improvement comprising:
a helium based Penning gaseous medium doped with oxygen operable to provide a luminous gaseous medium which exhibits multicolor emission due to the efficient recombination of oxygen ions during said discharge condition.

2. The AC gas discharge display panel set forth in claim 1 wherein said helium based gaseous medium comprises helium in an approximate pressure range of between 100 to 1000 Torr.

3. The AC gas discharge display panel as set forth in claim 2 wherein said pressure range is from approximately 300 Torr to approximately 500 Torr.

4. The AC gas discharge display panel set forth in claim 2 wherein said helium is at least at 300 Torr and is doped with oxygen at a concentration level of from 0.1 to 5% of the total gaseous concentration.

5. The AC gas discharge display device as set forth in claim 1 wherein said gas discharge display panel includes
said respective dielectric layers covering sets of conductive lines on each of the opposing substrates plates thereof
with said dielectric layers
each including a high secondary emission refractory layer deposited thereon with the surface of one side thereof in contact with said helium based gaseous medium and
each being of thickness to optimize luminous brightness of said excited gaseous medium.

6. The AC gas discharge display panel as set forth in claim 5 wherein
said high secondary electron emission refractory layer is an MgO layer which enhances stoichiometry resulting from said oxygen in said gaseous mixture.

7. In an AC gas discharge display panel containing therein
a luminous ionizable gaseous medium with a pronounced visible discharge emission sealed between a pair of opposing substrate plates,
each of which substrate plates has deposited on the internal surface thereof sets of conductive lines covered with at least one layer of dielectric material exhibiting dielectric properties such that substantially all of the drive voltage for said panel is periodically transferred thereto to establish a discharge condition across said gaseous medium,
said gaseous medium comprising:
a Penning mixture of helium and a species of gas operable for obtaining multicolor visible light emissions from said panel.

8. The panel of claim 7 wherein there is associated a filter to select a given color of said multicolor for display.

9. The AC gas discharge panel as set forth in claim 7 wherein said molecular species is selected from the group consisting of $O_2$, $N_2$ and $H_2$.

10. In an AC gas discharge display panel containing therein
a luminous ionizable gaseous medium with a pronounced visible discharge emission sealed between a pair of opposing substrate plates,
each of which substrate plates has deposited on the internal surface thereof sets of conductive lines covered with at least one layer of dielectric material exhibiting properties such that substantially all of the drive voltage for said panel is periodically transferred thereto to establish a discharge condition across said gaseous medium,
said gaseous medium comprising:
a Penning mixture of helium and an atomic species selected from the group consisting of Xe and Kr operable for obtaining multicolor visible light emissions from said panel.

11. In a method of fabricating an AC gas discharge display panel having
a luminous ionizable gaseous medium with a pronounced visible discharge emission sealed between a pair of opposing substrate plates,
each of which substrate plates has deposited on the internal surface thereof sets of conductive lines covered with at least one layer of dielectric material exhibiting dielectric properties such that substantially all of the drive voltage for said panel is periodically transferred thereto to establish a discharge condition across said gaseous medium, the improvement comprising the step of:
including a Penning mixture of helium and another species of gas operable for obtaining multicolor visible light emissions from said panel, and
controlling the luminous brightness of said panel by establishing a given thickness of said dielectric material wherein the thinner said material is, the brighter is said panel.

12. In a method of operating an AC gas discharge display panel containing therein a luminous ionizable gaseous medium with a pronounced visible discharge emission sealed between a pair of opposing substrate plates, each of which substrate plates has deposited on the internal surface thereof sets of conductive lines covered with at least one layer of dielectric material exhibiting dielectric properties such that substantially all of the drive voltage for said panel is periodically transferred thereto to establish a discharge condition across said gaseous medium, the improvement comprising the step of:

including a Penning mixture of helium and another species of gas operable for obtaining multicolor visible light emissions from said panel, and controlling the luminous brightness of said panel by establishing a given sustain frequency.

13. In a method of operating an AC gas discharge display panel containing therein a luminous ionizable gaseous medium with a pronounced visible discharge emission sealed between a pair of opposing substrate plates, each of which substrate plates has deposited on the internal surface thereof sets of conductive lines covered with at least one layer of dielectric material exhibiting dielectric properties such that substantially all of the drive voltage for said panel is periodically transferred thereto to establish a discharge condition across said gaseous medium, the improvement comprising the steps of:

including a Penning mixture of helium and another species of gas operable for obtaining multicolor visible light emissions from said panel determining a given color characteristic of said luminosity of said medium by shaping the pulse height and pulse width of the drive voltage pulses.

14. The method of claim 13 wherein said shape of said drive voltage pulses is in the approximate range of one nanosecond to 100 nanoseconds.

15. In a method of fabricating an AC gas discharge display panel having a luminous ionizable gaseous medium with a pronounced visible discharge emission sealed between a pair of opposing substrate plates, each of which substrate plates has deposited on the internal surface thereof sets of conductive lines covered with at least one layer of dielectric material exhibiting dielectric properties such that substantially all of the drive voltage for said panel is periodically transferred thereto to establish a discharge condition across said gaseous medium and exhibiting electron emission characteristic when a plasma discharge is established by pairs of said conductive lines, the improvement comprising the steps of:

including a material for said electron emission characteristic determined by a given atomic species, and including a Penning gaseous medium comprising one species of gas thereof the same as said atomic species operable for obtaining multicolor visible light emissions from said panel.

16. In an AC gas discharge display panel containing therein a luminous ionizable gaseous medium with a pronounced visible discharge emission sealed between a pair of opposing substrate plates, each of which substrate plates has deposited on the internal surface thereof sets of conductive lines covered with at least one layer of dielectric material exhibiting properties such that substantially all of the drive voltage for said panel is periodically transferred thereto establish a discharge condition across said gaseous medium, said gaseous medium comprising:

a Penning mixture of helium and another species of gas operable for obtaining visible light emission from said panel at drive voltage frequency in excess of 200 kilohertz so that a substantial panel operating voltage memory margin is obtained.

17. The panel of claim 16 wherein said drive frequency is in excess of one megahertz.

18. In a method of fabricating an AC gas discharge display panel having a luminous ionizable gaseous medium with a pronounced visible discharge emission sealed between a pair of opposing substrate plates, each of which substrate plates has deposited on the internal surface thereof sets of conductive lines covered with at least one layer of dielectric material exhibiting dielectric properties such that substantially all of the drive voltage for said panel is periodically transferred thereto to establish a discharge condition across said gaseous medium, the improvement comprising the steps of:

including a Penning mixture of helium and another species of gas operable for obtaining multicolor visible light emissions from said panel, and controlling the resolution of said panel by controlling conductive line width and line density, wherein the narrower the line width and higher the density, the greater is the glow confinement per gas discharge cell.

19. The method of claim 18 wherein said line width is the approximate range of 0.5 to 4 mils and said said line density is in the approximate range of 100 to 150 lines per inch.

20. The method of claim 18 wherein said dielectric material is borosilicate glass.

21. The panel of claim 9 wherein said molecular species is $O_2$.

22. Method as set forth in claim 11 wherein said species is the molecular species oxygen.

23. Method as set forth in claim 12 wherein said another species is the molecular species oxygen.

24. Method as set forth in claim 13 wherein said another species is the molecular species oxygen.

25. Method as set forth in claim 15 wherein said material for said electron emission characteristic is MgO and said Penning gaseous medium comprises helium doped with molecular oxygen.

26. Method as set forth in claim 18 wherein said another species is the molecular species oxygen.

* * * * *